United States Patent [19]

Elliott

[11] 4,409,522

[45] Oct. 11, 1983

[54] DIRECT CURRENT POWER SOURCE FOR AN ELECTRIC DISCHARGE LAMP USING REDUCED STARTING CURRENT

[75] Inventor: William J. Elliott, Zephyr Cove, Nev.

[73] Assignee: Quietlite International, Inc., Reno, Nev.

[21] Appl. No.: 297,146

[22] Filed: Aug. 28, 1981

[51] Int. Cl.[3] ..... G05F 1/00; H05B 37/02

[52] U.S. Cl. ..... 315/308; 315/311; 307/570

[58] Field of Search ..... 315/308, 311; 307/570

[56] References Cited

U.S. PATENT DOCUMENTS 3,238,415 3/1966 Turner ..... 315/311

4,162,429 7/1979 Elms et al. ..... 315/308

4,289,993 9/1981 Harper et al. ..... 315/308

4,303,841 12/1981 Baker ..... 307/570

*Primary Examiner*—Harold A. Dixon

*Attorney, Agent, or Firm*—Allegretti, Newitt, Witcoff & McAndrews, Ltd.

[57] ABSTRACT

A solid-state electronic ballast circuit for supplying direct-current power to an electric discharge vapor lamp is disclosed. The source-drain channel of a Vertical Metal Oxide Semiconductor (VMOS) Field Effect Transistor (FET) is connected in series with the lamp across a DC source. A resistance network controls the conductivity of a bipolar transistors, which in turn controls the conductivity of the VMOS channel, in response to variations in channel voltage, lamp voltage and lamp current.

10 Claims, 2 Drawing Figures

DIRECT CURRENT POWER SOURCE FOR AN ELECTRIC DISCHARGE LAMP USING REDUCED STARTING CURRENT

BACKGROUND OF THE INVENTION

This invention relates to an improved direct current solid-state ballast for efficiently supplying regulated electrical power to an electric discharge lamp.

In comparison to conventional incandescent (tungsten filament) lamps, electric discharge lamps produce light with much greater efficiency and have a much longer life. As awareness of the need to conserve energy and to reduce maintenance costs has grown, high intensity discharge (HID) lamps have become the frequent choice over incandescent lamps, particularly to meet industrial, commercial and outdoor lighting needs.

Conventional HID lamps are normally powered by alternating current which flows through an inductive (magnetic core and coil) ballast. The ballast is needed in order to limit the current flow through the negative-resistance discharge lamp. In order to house and support the necessarily large and heavy magnetic ballast, the lamp fixtures and fixture supports themselves must be large and sturdy. Thus, the relatively high overall installation cost of HID lighting systems can be attributed in large part to the cost, size and weight of the conventional AC magnetic ballast.

In U.S. Pat. No. 4,289,993 issued to William J. Elliott and Clarence F. Harper, a preferred electronic solid-state ballast circuit is disclosed which is smaller, lighter and less expensive than a conventional core-and-coil ballast and which is capable of efficiently operating an electric discharge vapor lamp during start-up, warm-up and sustained use without generating electromagnetic interference or acoustic vibrations.

In this prior arrangement, the discharge lamp is serially connected with a semiconductor ballast circuit across a source of a direct current potential. The ballast circuit monitors and regulates the flow of power to the lamp by limiting the flow of current to the lamp to a safe value when the lamp is first ignited and thereafter by decreasing the effective resistance of the control circuit as the vapor pressure within the lamp increases, thereby greatly reducing the power dissipated in the ballast circuit during normal operation for increased efficiency. This prior semiconductor ballast circuit is connected in series with the lamp and comprises a fixed ballast resistor and one or more transistors connected in parallel. At the time the lamp ignites, the parallel transistor is substantially non-conducting so that substantially all of the lamp current flows through the ballast resistor. As lamp voltage increases and lamp current decreases (due to increasing vapor pressure within the lamp during the warm-up period), means responsive to the lamp's changing operating parameters are employed for increasing the conductivity of the transistor(s), providing a secondary source of current for the lamp, and reducing the effective resistance and power dissipation of the ballast circuit.

U.S. Pat. No. 4,358,717 issued to William J. Elliott describes an improved arrangement in which the size, cost and complexity of the ballast circuit is still further reduced through the use of a semiconductor device whose performance characteristics are uniquely adapted to the task of regulating the power supplied to an HID lamp. In that arrangement, the electrical energy delivered to the lamp is advantageously controlled by connecting the lamp across a direct current source in series with the source-drain channel of an insulated gate Vertical Metal Oxide Semiconductor (VMOS) Field Effect Transistor (FET), the conductivity of the channel being regulated by a control potential applied to the gate electrode of the FET. Devices of this general class are also referred to as Double-diffused Metal Oxide Semiconductor (DMOS) power transistors. The high input impedance and high gain of the VMOS FET allows its channel conductivity to be accurately and reliably controlled in response to both lamp current and lamp voltage fluctuations, by means of a simplified control circuit which, in a preferred embodiment, comprises the combination of a resistor (connected in series with the lamp to sense lamp current), a voltage divider (connected in parallel with the lamp to sense lamp voltage), and a single low-power transistor which supplies a control potential to the gate electrode of the FET in order to regulate the lamp's operation.

As disclosed in Elliott U.S. Pat. No. 4,358,717, the improved solid-state ballast circuit may be advantageously fabricated in the form of a single hybrid microelectronic circuit in which the silicon wafer which forms the VMOS FET and the bipolar control transistor are directly attached to a non-conductive substrate upon which an appropriate pattern of metallic conductors and then film resistors has been applied. In this way, all of the components of the ballast circuit (with the exception of the fixed ballast resistor and the power supply capacitors) may, in effect, be reduced to a single component which may be readily mass-produced.

Solid-state HID lamps ballast circuits constructed in accordance with the principles disclosed in U.S. Pat. Nos. 4,289,993 and 4,358,717 have been shown to possess significant advantages. However, the use of a fixed ballast resistor to provide starting current to the lamp immediately after ignition creates certain problems. Because the fixed ballast resistor must dissipate a substantial amount of heat (typically in excess of 100 watts) for several minutes during the lamp start-up period, the resistor is necessarily bulky and must be thermally isolated from the remaining electronics in order to prevent heat damage. Secondly, the relatively high lamp starting current flowing through the ballast resistor forms the most significant source of heat in the ballast unit, requiring that the thermal mass or heat sinking capability of the unit be enlarged to hold the maximum temperature rise within acceptable limits.

SUMMARY OF THE INVENTION

Although high intensity discharge lamps are normally started with a lamp current 120% to 175% greater than the nominal operating current, it is possible to reliably start the lamp with a lamp current substantially less than the normal operating current. By limiting lamp current during warmup, when the voltage across the lamp is low and the voltage across the semiconductor ballast circuit is high, it is possible to eliminate the need for the fixed ballast resistor of the prior designs by instead allowing all of the starting current to flow through the transconductive path of one or more power transistors. In accordance with a principle feature of the present invention, means responsive to the voltage across the power transistor(s) reduce the conductivity of the transistor(s) during the warmup period to limit the amount of initial lamp current to a value substantially less than normal operating current.

In accordance with a further feature of the invention, means responsive to the magnitude of current flowing through the lamp deliver a variable, regulated level of current to the lamp, the regulated level being reduced below the normal operating level in response to higher voltages across the power transistor(s), in order to limit the amount of power dissipated in those transistor(s) during lamp startup.

In accordance with a further feature of the invention, means responsive to the magnitude of the voltage across the lamp may also be employed to reduce the conductivity of the power transistor(s) for lamp voltages in excess of a predetermined value whereby, during normal operation, the power delivered to the lamp is maintained at a substantially constant level.

In accordance with still another feature of the invention, the transistor(s) serially connected with the lamp for controlling lamp current preferably take the form of one or more vertical metal oxide semiconductor (VMOS) field-effect transistor(s) (FET).

These and other objects, features and advantages of the present invention will become more apparent through a consideration of the following detailed description of a specific embodiment of the invention. In the course of this description, reference will frequently be made to the attached drawing, in which:

DESCRIPTION OF THE PREFERRED EMBODIMENTS

Figure 1:
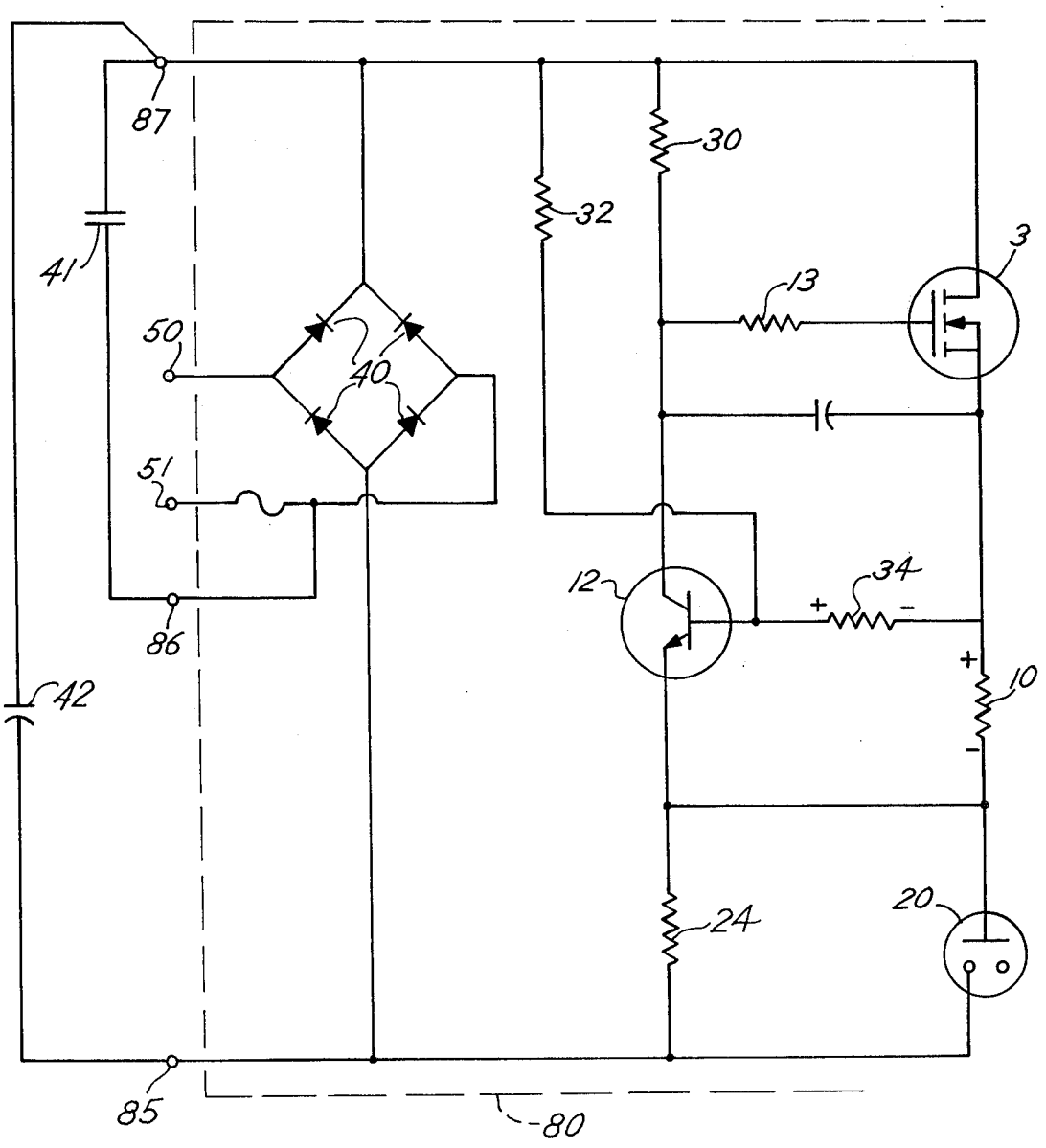
FIGS. 1 and 2 are schematic diagrams of improved solid-state ballasts which control the magnitude of energy supplied to an HID lamp and which embody the principles of the present invention.

The principal active elements employed in the improved ballast circuit of FIG. 1 is a Vertical Metal Oxide Semiconductor (VMOS) Field-Effect Transistor (FET) 3 whose source-drain channel is connected between the positive terminal of a DC power supply and one end of a current sensing resistor 10. The gate electrode of FET 3 is connected to the collector of a bipolar transistor 12 by means of a gate resistor 13. The emitter of transistor 12 is connected to the junction of resistor 10 and lamp 20. Resistor 24 is connected across the lamp 20. The collector of transistor 12 is connected by a resistor 30 to the positive terminal of the DC supply. A resistor 32 connects the base of transistor 12 to the positive terminal of the DC supply and a resistor 34 connects the base of transistor 12 to the source electrode of FET 3.

The DC supply comprises a conventional full-wave bridge rectifier comprising diodes 40, a voltage doubling capacitor 41 and a filter capacitor 42. When AC line voltage is supplied to the terminals 50 and 51, and before the lamp 20 ignites, the voltage across filter capacitor 42 rises to a value adequate to "fire" lamp 20 (approximately 300 volts for a mercury vapor lamp). Because of the small capacitance of the doubling capacitor 41 (relative to that of filter capacitor 42), the voltage doubling action ceases as soon as the lamp 20 begins to drain substantial current from the supply.

Immediately after ignition, the voltage across the lamp 20 falls to a low value (e.g. 15 volts). This low initial lamp voltage results from the fact that, in HID lamps, the initial electron flow takes place solely through a starting gas, such as argon. As the lamp continues to burn, its heat begins to vaporize the mercury, sodium or metal halide which is deposited on the inside walls of the cold arc tube. As the vapor pressure within the tube builds, the voltage across the lamp increases.

After lamp ignition, three factors influence the conductivity of the transconductive, source-drain path of the VMOS FET device 3. First, any increase in current through the current sensing resistor 10 increases the conductivity of the collector-emitter path of transistor 12, and reduces the forward-biasing voltage applied to the gate electrode of FET 3 reducing its conductivity, and tending to maintain lamp current at a regulated level. The magnitude of this regulated level is varied, however, in response to the voltage across the VMOS FET 3, thus limiting lamp current to reduce power dissipation in the control circuit when the voltage across the ballast is high.

The reduction of lamp current when the voltage across the FET devices 3 is high is effected by the combination of resistors 32 and 34 which act as a voltage divider connected across the source-drain transconductive paths of the FET 3. When the lamp 20 is first ignited, the voltage across the lamp is low and the voltage across the FET is high. Thus, the relatively high voltage across resistor 34 is added to the voltage across the current sensing resistor 10 to increase the base drive to transistor 12 which in turn reduces the gate drive to the FET 3. In this way, the regulated level of lamp current is reduced during lamp warm-up. The lamp current during start-up may be maintained at a level substantially below that of the lamps nominal operating current level (e.g. 80% of nominal operating current).

As lamp voltage rises, the voltage across the FET device 3 drops, as does the forward-biasing voltage across resistor 34, allowing the lamp current to be increased as the need to limit power dissipation in the FET device diminishes.

Figure 2:
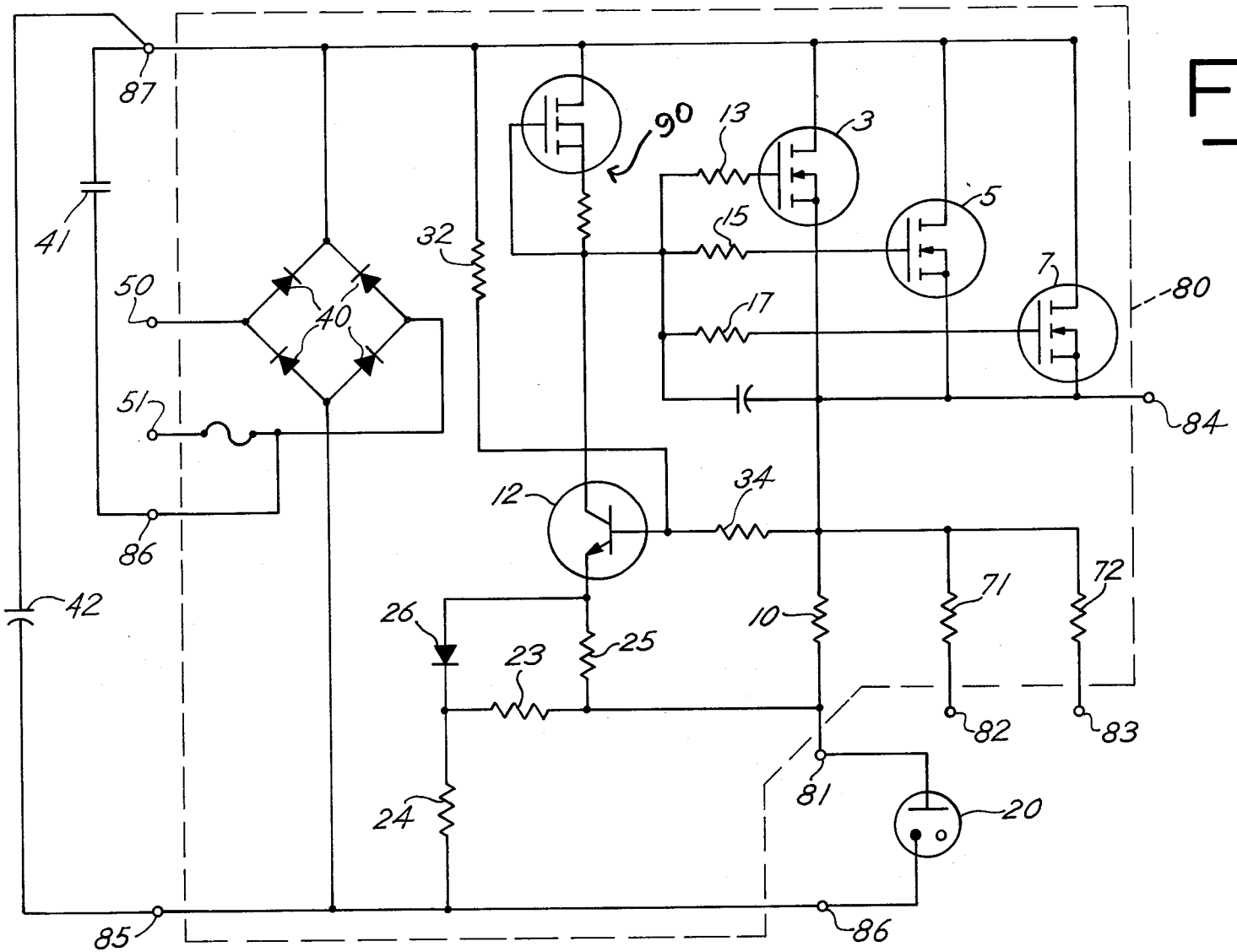

The arrangement shown in FIG. 2 is closely similar in structure and operation to the simpler circuit shown in FIG. 2 and the like reference numerals have been used to designate like components in the two Figures.

The circuit shown in FIG. 2 differs from that shown in FIG. 1 in four principle respects. First, three parallel FET devices 3, 5 and 7 (each having a gate resistor 13, 15 and 17 respectively) are used in the circuit of FIG. 2, instead of the single FET 3 shown in FIG. 1, to provide greater current handing capability. Secondly, the arrangement of FIG. 2 incorporates additional control circuitry (Resistors 23 and 25 and diode 26) to sense lamp voltage and to regulate the amount of power delivered to the lamp after the lamp has reached its normal operating temperature. Thirdly, the circuit of FIG. 2 incorporates two additional current sensing resistors 71 and 72 which may be employed to operate lamps having different rated currents by making appropriate connections to the connector points 81, 82 and 83. Finally, a current source device indicated generally at 90 in FIG. 2 replaces the collector resistor 30 seen in FIG. 1 to improve the operation of the circuit under high ripple voltage conditions.

The operation of the circuit of FIG. 2 during the initial start-up period when lamp voltage is low is directly similar to the operation of the circuit of FIG. 1 as described above. During this initial phase of the lamp warm-up period, there is insufficient voltage across resistor 23 to forward bias the diode 26. Eventually, however, the increasing lamp voltage becomes adequate to drive diode 26 into conduction, with the result that a forward-biasing voltage begins to build across the emitter resistor 25 as lamp voltage increases further. In this way, the conductivity of the VMOS FET devices 3, 5 and 7 may be decreased in response to lamp voltages in excess of a predetermined value to regulate the total amount of power to the lamp.

For added compactness and reduced manufacturing and handling costs in volume production, the electronic components (exclusive of the capacitors 41 and 42) which make up the device may be advantageously fabricated, in known ways, as a hybrid circuit in which the semiconductor devices 3, 5, 7 and 12 are attached, in wafer form, to a non-conductive substrate (such as a ceramic, silicon or beryllia) with a metallized pattern of conductors and semiconductors or film resistors being employed to make up the remainder of the circuit. That portion of the circuit which is fabricated in hybrid form is shown within the dashed line 80 in FIGS. 1 and 2. Connections to the hybrid circuit are made at external pins 50 and 51, which receive AC line voltage, and pins 81–88 which may be connected to other components.

The value of the current-sensing resistor 10 must be accurately set to fix the level of output current at the level desired for a particular lamp. In accordance with a feature of the invention, resistors 71 and 72 (shown in FIG. 2) may be connected between the source electrodes of FET's 3, 5 and 7 and pins 82 and 83 which are accessible externally of the hybrid circuit. In this way, different current sensing resistor values may be selected by merely "strapping" (connecting) the pin 82 (or both pins 82 and 83) to pin 81. Using the element values shown in the table below, a single hybrid-circuit may be used to power either 75 watt (no strapping), 100 watt (pins 81 and 82 connected) or 175 watt (pins 81, 82 and 83 connected) mercury vapor lamps.

TABLE OF ELEMENTS

| | |
|---|---|
| VMOS FET 3, 5 and 7 | VN0340N1(available from Supertex, Inc. of Sunnyvale, California) |
| Resistor 10 | 1.13 ohms |
| Transistor 12 | Type FT 431, NPN bipolar transistor |
| Resistors 13, 15 and 17 | 560 ohms |
| Lamp 20 | Mercury vapor lamp: type H43(75 watt), H38(100 watt), H39(175 watt) |
| Resistor 23 | 1.5 K ohms |
| Resistor 24 | 100 K ohms |
| Resistor 25 | 100 ohms |
| Diode 26 | IN914 |
| Capacitor 41 | 5 microfarads, 125 volts AC |
| Capacitor 42 | 300 microfarads, 350 volts |
| Resistor 71 | 3.27 ohms |
| Resistor 72 | 1.12 ohms |

The bipolar transistor 12 must have a high beta (common-emitter current again). In addition, the VMOS FET devices 3, 5 and 7 should have substantially similar gate threshold voltages to prevent "current hogging" by individual devices. For these reasons, care must be taken to avoid circuit malfunction because of significant departures from nominal performance figures due to variations in the manufacture of semiconductor devices themselves. In addition, the current sensing resistors 10, 71 and 72 should have accurate resistance to insure lamp operation at the desired power level. Such accuracy may be achieved in production by the known techniques of automated laser trimming of the film resistors used to form the hybrid circuit.

It is to be understood that the specific embodiment of the invention which has been described is merely illustrative of one application of the principles of the present invention. Numerous modifications may be made by those skilled in the art without departing from the true spirit and scope of the invention.

What is claimed:

1. A power supply for an electric discharge lamp comprising, in combination, a source of a direct current potential, current sensing means, at least one power transistor having a transconductive path and a control electrode, said transconductive path(s), said lamp, and said current sensing means being connected in series across said source, means responsive to said current sensing means for maintaining the magnitude of current flowing through said lamp at a regulated level, and means responsive to the voltage across said transconductive path(s) for increasing the magnitude of said regulated level as said voltage decreases during initial lamp warmup.

2. A power supply as set forth in claim 1 wherein said current sensing means comprises a current sensing resistance serially connected with said lamp and said transconductive path.

3. A power supply as set forth in claims 1 and 2 wherein said means responsive to said current sensing means comprises a further transistor connected to supply an amplified current-related signal to the control electrode(s) of said power transistor(s).

4. A power supply as set forth in claims 1, 2 or 3 wherein said power transistor takes the form of at least one vertical metal oxide semiconductor field effect transistor (VMOS FET) having its source-drain channel serially connected with said lamp and said current-sensing means.

5. A solid-state ballast circuit for supplying regulated power to an electric discharge lamp from a source of a direct current potential said circuit comprising, in combination, at least one VMOS field-effect transistor having a gate electrode and a source-drain channel, circuit means for serially connecting said channel and said lamp across said source, and means for supplying a control potential to said gate electrode to control the conductivity of said channel, said means comprising means for varying said control potential in response to changes in the magnitude of current flowing through said lamp to maintain said current at a regulated level, and means for varying said control potential in response to changes in the magnitude of voltage across said channel to reduce said regulated level of current when said voltage is high during initial lamp warmup.

6. A solid-state ballast circuit as set forth in claim 5 wherein said means for supplying a control potential comprises amplification means having an input and an output, said output being connected to said gate electrode and said input being connected to receive a first signal related to said voltage across said channel and a second signal related to the current through said channel.

7. A solid-state ballast as set forth in claims 5 or 6 further including means for varying said control signal in response to increases in the potential across said lamp in excess of a predetermined threshold potential to regulate the magnitude of power delivered to said lamp at its nominal operating potential, said threshold potential being less than said nominal operating potential.

8. A power supply for supplying a variable, regulated direct current to an electric discharge vapor lamp which comprises, in combination, a source of a direct current potential, a power transistor having a control electrode and a transconductive path, a current sensing resistor connected in series with said lamp and said transconductive path across said source, first circuit means connecting said current sensing resistor and said control electrode of said power transistor to limit the magnitude of current flowing through said lamp to a variable regulated level, and second circuit means connected to said control electrode for reducing the magnitude of said variable regulated level in response to increases in the potential across said transconductive path to limit the amount of power dissipated in said power transistor when the voltage across said lamp is low immediately following ignition.

9. A power supply as set forth in claim 8 further comprising said variable regulated level in response to increases in the voltage across said lamp in excess of a predetermined operating threshold to regulate the magnitude of power supplied to said lamp at lamp voltages in excess of said threshold.

10. A power supply as set forth in claims 8 or 9 wherein said power transistor takes the form of a vertical metal oxide semiconductor field-effect transistor (VMOS FET) having its source drain channel serially connected with said lamp and said current-sensing resistor.

* * * * *